United States Patent [19]

Laby et al.

[11] Patent Number: 4,623,330

[45] Date of Patent: Nov. 18, 1986

[54] GAS DIFFUSION-LIMITED CONTROLLED RELEASE DEVICES

[76] Inventors: Ralph H. Laby, 52 Bryson Street, Canterbury, Victoria; Bruno Kautzner, 20 McLaurin Road, Murrumbeena, Victoria, both of Australia

[21] Appl. No.: 466,949

[22] Filed: Feb. 16, 1983

[30] Foreign Application Priority Data

Feb. 16, 1982 [AU] Australia ..... PF2729

[51] Int. Cl.[4] ..... A61M 5/00

[52] U.S. Cl. ..... 604/63; 604/131; 604/230; 222/389

[58] Field of Search ..... 604/63, 57, 59, 60, 604/131, 134, 135, 140, 143, 147, 141, 230; 222/389, 34; 401/143, 176, 171, 177, 188

[56] References Cited

U.S. PATENT DOCUMENTS 1,737,844 12/1929 Heineman et al. ..... 604/230 X
2,809,774 10/1957 Kaye et al. ..... 222/389 X
3,604,417 9/1971 Stolzenberg ..... 604/131
4,389,202 6/1983 La Veen ..... 604/106 X

FOREIGN PATENT DOCUMENTS 520409 1/1982 Australia .

*Primary Examiner*—Stephen C. Pellegrino
*Attorney, Agent, or Firm*—Bacon & Thomas

[57] ABSTRACT

A device for controllably delivering a solid, paste or liquid material in biological, environmental or industrial systems. The device is in the form of a tubular body, one end of which is open to allow egress of the material, and the other is closed. A gas-tight plunger slides within the body by virtue of spring driving means and gas from the external environment which enters the closed end of the tubular body by way of a gas permeable membrane and acts, together with the spring on the rear face of the plunger. The plunger controllably ejects the material from the open end of the device. The device has particular use in the delivery of therapeutic and/or prophylatic materials to animals.

8 Claims, 8 Drawing Figures

GAS DIFFUSION-LIMITED CONTROLLED RELEASE DEVICES

This invention relates to controlled release devices, that is devices of the type which can provide controlled delivery of material in the form of solids, pastes or liquids. Such devices are used for example, in pharmaceutical and veterinary applications when the materials comprise or contain therapeutic or prophylactic drugs or other biologically active substances.

A device of the type in question is described in our Australian patent application No. 35908/78, with particular reference to its use in the intra-ruminal administration of therapeutic agents to ruminants. The present invention is concerned with modifications to that device, not only for use in ruminant husbandry and medication but also in the general field of animal and human medicine. For example, the device of the present invention may be adapted for intravaginal use. It may also be employed as a controlled release device for use in the general environment or in industrial processes.

The device described in our above-mentioned Application No. 35908/78 is described ih more detail hereinafter but broadly it is a variable geometry device for administration of a solid therapeutic composition and comprises a hollow body having an opening, a driving means for urging a solid therapeutic composition contained therein towards said opening, restricting means to prevent expulsion of the solid therapeutic composition therefrom by said driving means, a resilient member forming a first configuration with the body and which is capable of being resiliently deformed to provide a second configuration in which the device is capable of being administered to a ruminant per os, said resilient member being capable of reverting to the first configuration when the device reaches the rumen after administration thereof, said first configuration being such as to substantially reduce the possibility of regurgitation from said rumen. The variable geometry device may also include a means for inserting a precast plug of said therapeutic composition into the body.

In the preferred form of the device, the hollow body portion comprises a cylindrical tube open at one end, the other end having a base supporting a helical spring to which a plunger is attached which plunger is capable of being urged by the spring toward the opening.

Our earlier application also makes reference to the limitation of capsule operation by diffusion of gas through the core of matrix, past the loose-fitting plunger, into the spring chamber. The present invention now proposes limitation of the operation of a spring driven device totally to gas diffusion by using a gas-tight plunger and a gas diffusion membrane in the wall of the device connecting the spring chamber with the external environment.

According to the present invention, there is provided a controlled release device comprising a hollow tubular body adapted to contain a solid, paste or liquid material, one end of said body being at least partly open to allow egress of the material, the other end of said body being closed, a gas tight plunger adapted for slidable movement within the body, spring driving means located between the plunger and the closed end of the body for urging the plunger and hence the material ahead of the plunger towards the open end of the body, and wherein a membrane is provided in the closed end of the body and/or in the wall of the body adjacent the closed end whereby gas from the external environment can diffuse into the body behind the plunger and thereby allow the plunger to move under the influence of the spring means.

The plunger thus divides the body cavity into two chambers which for convenience are referred to herein as the "spring chamber" and the "payload chamber", i.e., that containing the material to be delivered.

The device of the present invention may also include means to vary its geometrical form, such as the resilient, deformable member of the earlier device described above.

Two principal modes of operation are envisaged, and have been made to operate in practice. These are (a) transfer of gas from an external gas-phase environment to the spring chamber (figuratively described as the "lung" system) and (b) transfer of gas from an external solution-phase environment to the spring chamber (figuratively described as the "gill" system). The lung system is applicable to the atmospheric or the intravaginal environment as described later while the gill system is particularly suited to the rumen, where the environmental gases are carbon dioxide and methane. Solids, pastes and liquids can all be delivered using these devices, the requirement for solids and pastes being that their natural dissolution of extrusion rate should be a little faster than when gas diffusion limitation is operating. When the devices are used with liquids it is desirable to include a non-return valve in the opening of the payload chamber. The operation of devices described in this application requires that the net spring force at the plunger be greater than zero as there are energy losses inevitably associated with their operation.

The net spring force ($F_{NS}$) is given by the equation:

$$F_{NS}=F-A(P_o-P)$$

where

F = the spring force on the plunger

A = plunger area, and $P_o-P$ = pressure drop across the diffusion membrane.

Energy losses include:

(i) friction loss at plunger-to-body contact (ii) friction loss at payload-to-barrel contact (if the payload is solid material)

(iii) rheological losses in flow processes at the opening, and (iv) yield pressure of a non-return valve if the payload is liquid.

Energy losses diminish the pressure drop across the diffusion membrane ($P_o-P$) which slows the diffusion rate. It is therefore advisable to reduce these losses to a minimum, and in particular to avoid non-Newtonian flow, which causes pulsating delivery. Plungers which operate by a process of alternate sticking and slipping (at a yield stress) or that show a yield stress well above operational friction can also cause pulsating delivery.

With a view to overcoming these problems, we have designated a form of plunger, for use in the device of the invention, which has low initial yield stress and frictional resistance. This plunger, which is an important aspect of this invention, essentially comprises a disc of a waxy solid material having lubricating properties and compression means for providing compressive forces on the disc in an axial direction, thereby to cause the disc to expand radially. The circumference of the disc is thereby forced against the inside walls of the body and a small amount of the lubricant is transferred to the walls thus lowering the yield stress and frictional resistance.

The relevant properties for the lubricant in this context are that it should be a waxy solid at the temperature of use (e.g., 39° C. for ruminants) and that it should have just sufficient resistance to flow under the action of the plunger spring to prevent it being forced out between plunger and barrel. Trial and error studies have shown that Teric 18M2 (I.C.I. Aust. Ltd.) is a suitable lubricant for this purpose.

The compression means preferably comprises two essentially rigid discs or plates which are slightly smaller in diameter than the lubricant disc which is clamped between the plates by a suitable spring mechanism, examples of which are described hereinafter. The spring mechanism in conjunction with the plates provides the necessary compressive force on the lubricant disc. Desirably the rearmost plate, i.e. that which in use defines one end of the spring chamber, is provided with a circumferential flange which assists in positively locating the drive spring of the device centrally behind the plunger.

There are many variations in membrane geometry and composition that have been found satisfactory for use in the devices of this invention. For example, very slow but usable release is achieved by the use of sealed polypropylene hypodermic syringe barrels, wherein the barrel itself acts as the diffusion membrane. Specific gas diffusion rates vary over a wide range depending on the membrane materials used and the gases involved. For example, a silicone membrane material, as used in the examples given herein, is about 300 times as permeable to $CO_2$ as polyethylene, and carbon dioxide diffuses more rapidly through all typical non-polar membrane materials than the other gases commonly encountered in our work, namely oxygen, nitrogen, argon and methane. The size of the device is unimportant to the principle of operation. Devices sized for internal use in both sheep and cattle have been prepared from 10 ml and 50 ml disposable hypodermic syringe barrels (Terumo Ltd.) and work equally well.

Other subjects and features of the invention will be appreciated from the following description of some preferred embodiments. Reference will be made to the accompanying drawings in which.

Figure 1A:
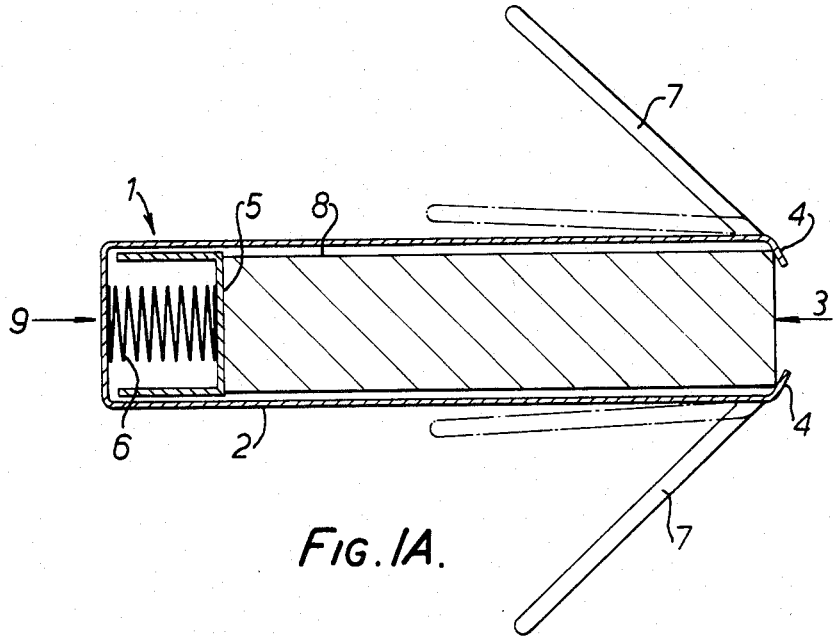
FIG. 1A is a sectional view of an intraruminal device in accordance with this invention.

FIG. 1A is a cross-sectional view of a variable geometry device according to the invention. The device 1 comprises a tubular body 2 having an opening 3 at one end, which opening is restricted by resilient projections 4 which protrude inwardly from said one end of the body. The other end 9 of the body is closed. The body contains a cupped gas-tight plunger 5 which is capable of sliding longitudinally thereof. The plunger is urged towards the open end 3 of the body 2 by means of a helical drive spring 6. The body has two resilient arms 7 attached thereto at said one end. The arms are attached to the body in such a manner that they normally project outwardly from said body at a suitable angle, e.g., approximately 45°, to form a first configuration. In the first configuration the device thus has the shape of an arrow-head. The arms 7 are capable of being resiliently flexed about an axis corresponding approximately with the junction of the arms with the body, to form a second configuration in which the arms are substantially parallel to the length of the body as shown by the dotted lines in FIG. 1A. With the arms folded back into the second configuration the device is capable of being administered to cattle per os. As shown in FIG. 1A, the body contains payload, in this instance a precast cylindrical plug 8 of a therapeutic composition. The resilient projections 4 are sufficiently flexible to allow the precast plug to be inserted into the device but have sufficient rigidity to retain the plug within the device against the pressure exerted by the spring. Alternatively, a barrier preventing ejection of the plug by action of the spring can be applied after the plug has been inserted, e.g., a strip of polypropylene welded across the opening 3 of the body. As a second alternative, the plug may be inserted from the spring end prior to insertion of the plunger and the spring.

The body 2, arms 7 and projections 4 may be integrally moulded from a suitable plastics material such as polyethylene, polypropylene or nylon. By choice of the appropriate material of construction a device may be obtained which can be retained in the rumen indefinitely or for lesser periods of time. For example, a device integrally moulded from low density, low molecular weight polyethylene will eventually fail after about 270 days in the rumen by flex cracking of the arms. On the other hand, a device integrally moulded from polypropylene is virtually indestructable.

To allow ingress of gas into the spring chamber which is defined by the plunger 5, the end 9 of the body and the walls of the body, the end 9 and/or the walls adjacent thereto are either gas-permeable or are provided with a gas-permeable membrane (not shown). In use, permeation of gas into the spring chamber allows the plunger 5 to move forward under the impetus of the drive spring 6 and hence extrude the payload 8 out of the open end of the body.

Typically the body has a length of 14 cm and a diameter of 2.8 cm for use in cattle, and a length of 9 cm and a diameter of 1.6 cm for use in sheep. The helical spring is made from spring steel wire having a circular cross-section of 0.5 mm in diameter. The spring comprises 20 to 30 coils and is capable when fully compressed of exerting a pressure of approximately 600 g (cattle) and 300 g (sheep).

Figure 1B:
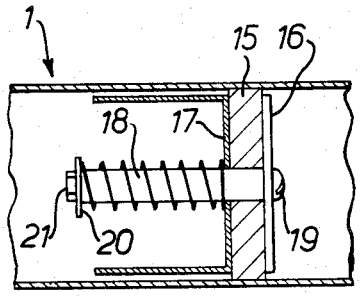
FIGS. 1B and 1C are part views of the device shown in FIG. 1A showing alternative forms of the plunger.

FIG. 1B shows a modified form of plunger assembly in accordance with a preferred embodiment of the invention. This consists of a piston 15 formed from a suitable waxy solid material (as described elsewhere) which is supported by, and clamped between a disc 16 and a cup-shaped member 17, both of which may be made of metal or a plastics material. The diameters of disc 16 and member 17 are slightly less than the internal diameter of the body 1. The disc 16 and member 17 are urged towards each other by a spring assembly comprising a compression spring 18, bolt 19, washer 20 and nut 21. The rear face of the member 17 abuts the end of the drive spring 6 (not shown) and transmits its pressure to the piston. The effect of the spring assembly is to compress the piston 15 axially and hence causes it to expand radially thereby ensuring good gas-tight contact between the piston and the walls of the body 1.

Figure 1C:
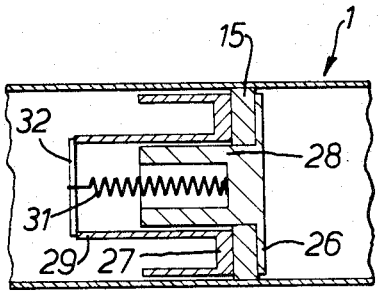

FIG. 1C shows a further alternative form for the plunger assembly. In this case the disc 26 (corresponding to disc 16 in FIG. 1B) is provided with a centrally-located blind boss 28 which passes through the piston 15. The cup-shaped member 27 (corresponding to 17) also has a centrally-located, open-ended boss 29 sized to allow free movement of the boss 28 within it. The disc 26 and member 27 are urged towards each other by a tension spring 31 attached to the bottom of boss 28 and to a bar 22 or like member spanning the free end opening of boss 29.

Obviously, other variations are possible for the plunger assembly construction.

Figure 1D:
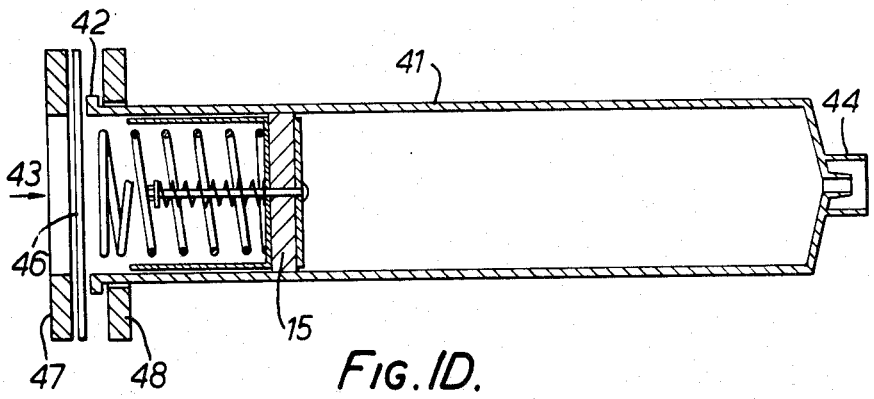
FIG. 1D is a sectional view of the experimental device described in the Examples.

The device shown in FIG. 1D is an experimental controlled release device for use in rumen fistulated cattle. It comprises a disposable polypropylene hypodermic syringe barrel 41 which has the usual flange 42 at its open end 43 and a nozzle portion 44 at the other end which normally receives the hypodermic needle (not shown). A diaphragm 46 consisting of a gas-porous membrane material is clamped to the flange 42 by means of a pair of clamping rings 47, 48 to provide a gas-tight seal around between the flange 42 and the diaphragm 46. The rings 47, 48 are held together by any suitable means, e.g., screws (not shown).

The plunger assembly 50 is that shown in FIG. 1B.

Using the device described in FIG. 1D various trials have been performed. Details of results are given in the following examples which further illustrate the principles and practice of the invention.

EXAMPLE 1

Plastic components of the plunger assembly (disc 16 or 26 and member 7 or 27 shown in FIGS. 1B and 1C were made of polypropylene or perspex. The compression spring of the FIG. 1B plunger exerted a 1500 g force and the tension spring of the FIG. 1C plunger a 1200 g force. The piston material used was Teric 18M2 manufactured by I.C.I. Aust. Ltd.).

Figure 2:
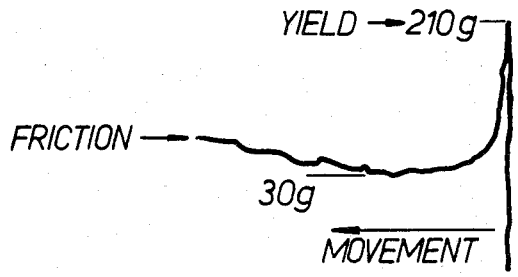
FIG. 2 is a graph showing the movement characteristics of the devices of FIG. 1D.

Typical movement characteristics for these plungers are given in FIG. 2. At a movement velocity of 0.0208 mm $sec^{-1}$, these plungers show yield stresses between 100 and 400 g and frictional resistances between 20 and 200 g. By comparison, rubber plungers from the disposable syringes which provide the barrels for these studies (manufactured by Terumo Ltd.) show yield stress between 500 and 1500 g and frictional resistances between 300 and 500 g. In addition, at the low velocities studied, the rubber plungers move in stick-slip steps on many occasions because of their elastic deformation. Also, their movement is much more sensitive to distortions in the barrel.

EXAMPLE 2

Studies were carried out on the in vivo release of Teric 12A23B from intraruminal devices in accordance with this invention equipped with non-return valves.

Figure 3:
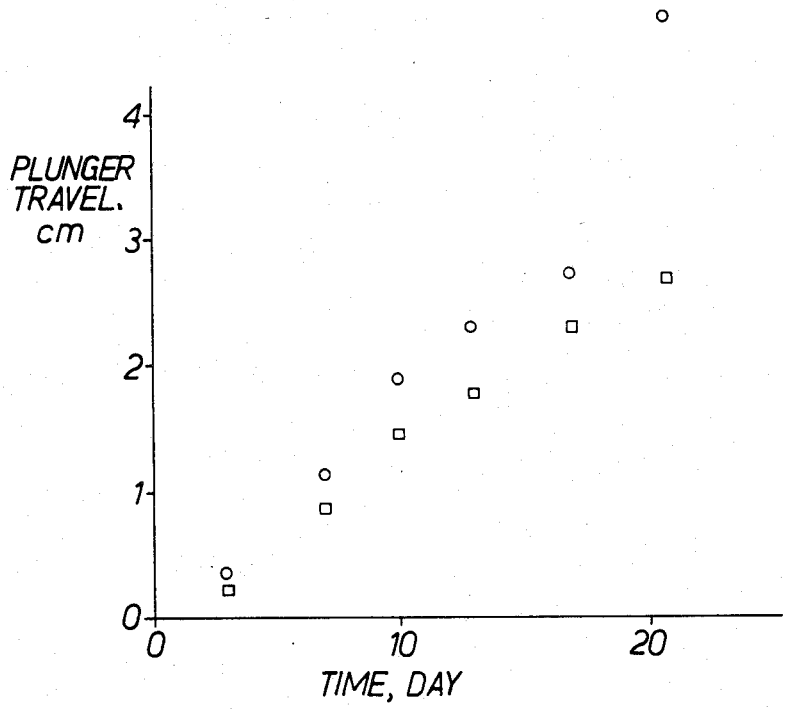
FIGS. 3, 4 and 5 are graphs showing the performance of various devices in accordance with FIG. 1D.

Two devices as depicted in FIG. 1D were prepared from 50 ml disposable "Terumo" syringes. They contained 45 ml of "Teric" 12A23B (I.C.I. Aust. Ltd.) which is an antibloat agent, solid at room temperature and liquid at 39° C. and were equipped with FIG. 1B plungers and drive springs of 330 20 g at 75% compression. The diaphragm 46 was a 20 mm diameter, 1.25 mm thick silicone membrane, reincorced type 501-1 (Dow Corning Corp.). The nozzle ends of the syringes were fitted with non-return valves fashioned from No. 33 Suba seals by splitting the seals with a razor blade. Rumen gases moved from ruminal solution to the spring chamber mainly through the silicone membrane. The performance of the devices are shown in FIG. 3, showing plunger travel as a function of time.

EXAMPLE 3

In vivo release of Teric 12A23B was studied as in Example 2, but the devices equipped with capillary outlets instead of non-return valves.

Four devices were constructed as described in Example 2. One device was equipped with a non-return valve, as in Example 2, and three with capillary outlets:

(a) 10 mm × 1 mm diameter stainless steel
(b) 40 mm × 1.66 mm diameter polyethylene capillary and
(c) 20 mm × 1.66 mm diameter polyethylene capillary.

Figure 4:
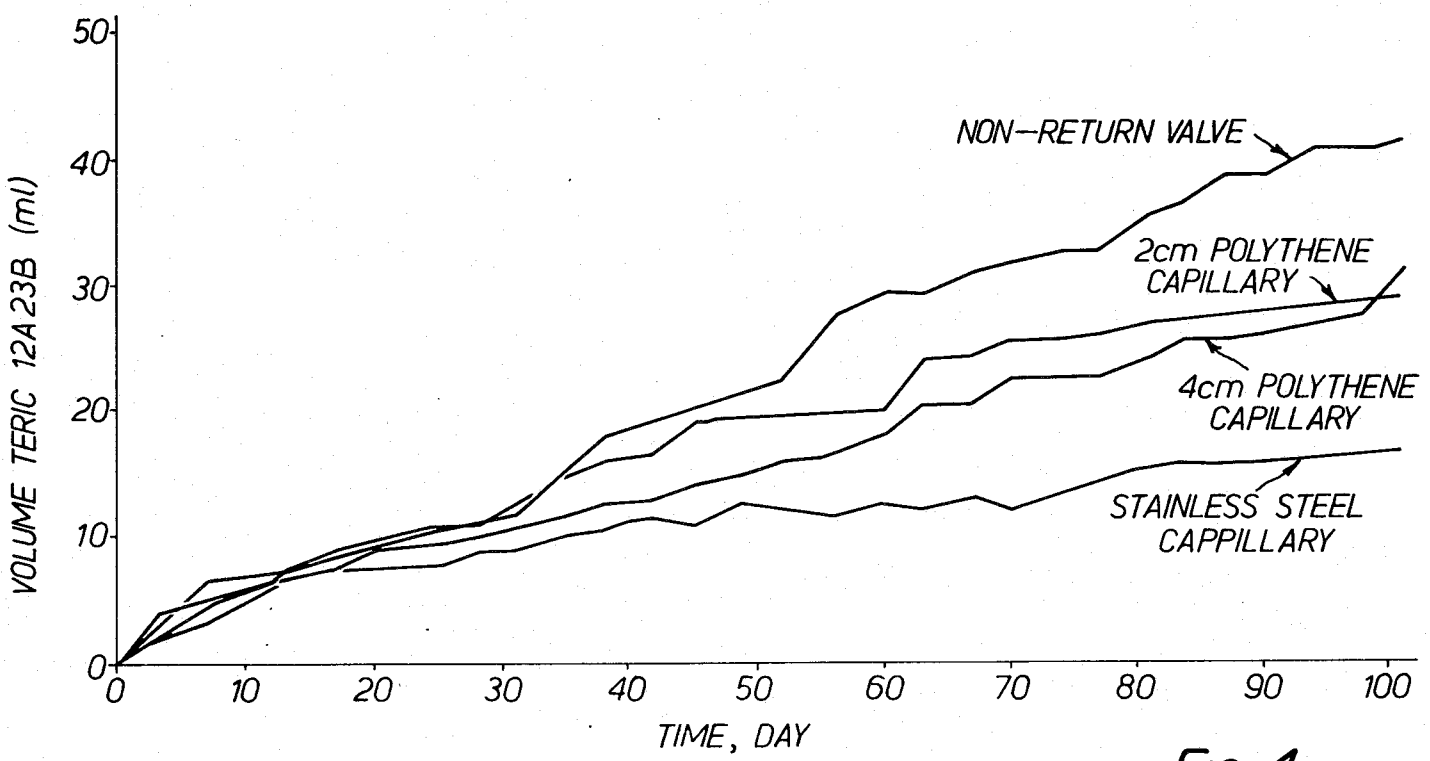

Results are given in FIG. 4, expressing the amount of Teric 12A23B (ml) released with time in the rumen of fistulated cattle. The device fitted with the stainless steel capillary ran at the rate shown in FIG. 4 for 180 days when it was removed. Capillaries are prone to blockage when used in this manner, and we have found that the outlet to the rumen should be covered with a gauze or a sintered plastic disc to prevent blockage.

EXAMPLE 4

The operation was examined of devices in which the diffusion of atmospheric air through a membrane limits the output rate.

Figure 5:
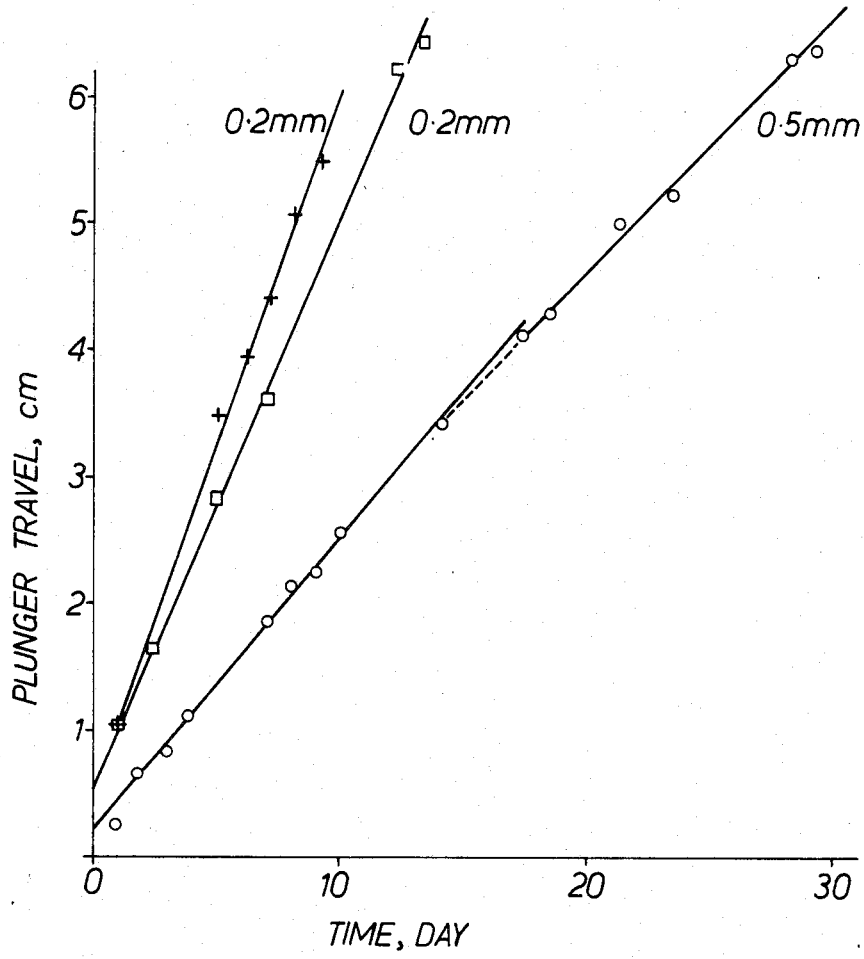

Devices were prepared from 50 ml "Terumo" disposable syringe barrels as described in Example 2, but with reinforced silicone membranes of 32 mm diameter, and thickness 0.5 or 0.2 mm as specified, FIGS. 1B and 1C plungers (see Example 1) and containing water instead of another biologically active fluid of some specific nature. Drive springs were of 400 g strength at 75% compression. The capsules were not fitted with capillaries or non-return valves. They were fitted with sealing caps which were removed at the start of the experiments. For the experiments, the capsules were placed in an air incubator at 39° C. Results are given in FIG. 5.

This example applies to an intravaginal implant where access of atmospheric air to the external surface of the diffusion membrane is achieved by a fine plastic tube which serves a further purpose as the means of withdrawing the device when required. It also applies to general environmental devices, e.g., for the dispensing of insect pheromones at rates slower than their evaporation rates.

EXAMPLE 5

The effect of temperature on the release rate of gas diffusion limited spring driven devices.

Devices were prepared using 50 ml "Terumo" syringe barrels equipped with sealing plungers as described herein and containing layers of Teric 18M2 (I.C.I. Aust. Ltd.) each of volume 1.6 ml. Drive springs were 400 g force at 75% compression. Membranes were reinforced silicone 0.18 mm thick and 28 mm exposed diameter. Devices contained 50 ml water and were maintained in vitro at 25° C., 39° C. and 45° C. in duplicate. Mean release rates are given in table below:

| Temperature °C. | Mean Release Data ml, d | Duration of measurement, days |
|---|---|---|
| 45 | 4.67 | 1 to 6 |

-continued

| Temperature °C. | Mean Release Data ml, d | Duration of measurement, days |
|---|---|---|
| 39 | 3.20 | 1 to 10 |
| 25 | 1.47 | 1 to 20 |

We claim:

1. A device for delivering a solid or liquid paste material at a controlled rate comprising a hollow tubular body having one end which is at least partially open and another end which is closed, a gas tight plunger located inside the body so as to be capable of slidable movement within the body, the plunger comprising a disc of waxy solid material having lubricating properties which decreases the yield stress and frictional resistance between the plunger and the body, compression means for providing compressive forces on the disc in the axial direction, thereby urging the disc to expand radially and a spring means under compression located between the closed end and the plunger for urging the plunger towards the open end as the spring means expands, said material being locatable between the plunger and open end so that movement of the plunger towards the open end dispenses material through the open end of the device, wherein said device is provided with a gas permeable membrane at or adjacent the closed end of the body, such that gas from outside of the body may diffuse through the membrane internally into the body behind the plunger at a controlled rate to thereby control movement of the plunger under the influence of the spring means to dispense the material at a controlled rate in use.

2. A controlled release device as claimed in claim 1, wherein the disc of waxy material having lubricating properties is stearylamine diethoxylate.

3. A controlled release device as claimed in claim 1, wherein the compression means comprises two essentially rigid plates which are slightly smaller in diameter than the lubricant disc which is clamped between the plates by a spring mechanism.

4. A controlled release device as claimed in claim 1, wherein the gas diffusion membrane is composed of a material selected from the group consisting of polypropylene polyethylene, natural rubber, polyvinylchloride and silicone.

5. A controlled release device as claimed in claim 1 and adapted to contain a liquid, said device including a non-return valve in the open end of the tubular body.

6. A controlled release device as claimed in claim 1 further including a resilient member connected to the tubular body of the device, said resilient member being resiliently deformable between a first configuration to a second configuration thereby to facilitate administration of the device to an animal when in the second configuration and wherein when the device reaches the desired location within the animal after administration, the resilient member is capable of reverting to the first configuration so as to substantially reduce the possibility of expulsion of the device from the animal.

7. A controlled release device as claimed in claim 1, wherein said gas permeable membrane comprises the walls of the body adjacent the closed end.

8. A device for delivering a solid or liquid paste material at a controlled rate comprising a hollow tubular body having one end which is at least partially open and another end which is closed, a gas tight plunger located inside the body so as to be capable of slidable movement within the body, the plunger comprising an elastic or resilient moulded material containing a waxy lubricant having lubricating properties which decreases the yield stress and frictional resistance between the plunger and the body, compression means for providing compressive forces on the elastic or resilient moulded material containing the waxy lubricant so that the waxy lubricant is forced to expand radially against the inside walls of the tubular body and a spring means under compression located between the closed end and the plunger for urging the plunger towards the open end as the spring means expands, said material being locatable between the plunger and open end so that movement of the plunger towards the open end dispenses material through the open end of the device, wherein said device is provided with a gas permeable membrane at or adjacent the closed end of the body, such that gas from outside of the body may diffuse through the membrane internally into the body behind the plunger at a controlled rate to thereby control movement of the plunger under the influence of the spring means to dispense the material at a controlled rate in use.

* * * * *